US007515724B2

(12) United States Patent
Salehi

(10) Patent No.: US 7,515,724 B2
(45) Date of Patent: Apr. 7, 2009

(54) LOUDSPEAKER DRIVER

(76) Inventor: Kourosh Salehi, 337 E. 50th St., #2A, New York, NY (US) 10022

( * ) Notice: Subject to any disclaimer, the term of this patent is extended or adjusted under 35 U.S.C. 154(b) by 0 days.

(21) Appl. No.: 11/732,393

(22) Filed: Apr. 3, 2007

(65) Prior Publication Data

US 2007/0286439 A1 Dec. 13, 2007

Related U.S. Application Data

(60) Provisional application No. 60/789,256, filed on Apr. 5, 2006, provisional application No. 60/875,089, filed on Dec. 15, 2006.

(51) Int. Cl.
*H04R 25/00* (2006.01)

(52) U.S. Cl. ..... 381/182; 381/398; 381/401

(58) Field of Classification Search ..... 381/182, 381/186, 398, 400, 401, 402, 403, 421, 423, 381/432, 152, 386; 181/144, 147, 163, 171, 181/172

See application file for complete search history.

(56) References Cited

U.S. PATENT DOCUMENTS

| | | | | |
|---|---|---|---|---|
| 2,551,556 | A | | 5/1951 | Brennan |
| 3,125,647 | A | | 3/1964 | Rouy |
| 4,590,333 | A | | 5/1986 | Strohbeen |
| 5,073,946 | A | * | 12/1991 | Satoh et al. ..... 381/349 |
| 5,295,194 | A | | 3/1994 | Christensen |
| 5,604,815 | A | * | 2/1997 | Paddock ..... 381/396 |
| 5,682,436 | A | | 10/1997 | Sakamoto et al. |
| 5,841,880 | A | | 11/1998 | Sakamoto |
| 6,496,586 | B1 | | 12/2002 | Hayes et al. |
| 6,973,194 | B2 | | 12/2005 | Iwasa et al. |
| 2004/0202347 | A1 | | 10/2004 | Koike |
| 2005/0286729 | A1 | | 12/2005 | Harwood et al. |

OTHER PUBLICATIONS

International Search Report issued Oct. 2, 2008 in corresponding PCT Application Serial No. PCT/US07/08488.

* cited by examiner

*Primary Examiner*—Huyen D Le

(57) ABSTRACT

A loudspeaker driver that includes a suspended diaphragm and a plurality of voice coils each suspended in a magnetic field and coupled to the diaphragm.

26 Claims, 23 Drawing Sheets

LOUDSPEAKER DRIVER

RELATED APPLICATION

The present application claims priority to U.S. Provisional Application No. 60/789,256, entitled Electronic presentation system and method & loudspeaker, to Kourosh Salehi et al. filed on Apr. 5, 2006, the entire disclosure of which is incorporated by reference, and claims priority to U.S. Provisional Application No. 60/875,089, entitled Multi-motor Loudspeaker Driver to Kourosh Salehi filed on Dec. 15, 2006, the entire disclosure of which is incorporated by reference.

BACKGROUND OF THE INVENTION

Referring to FIG. 1, a typical loudspeaker driver includes a cone-shaped diaphragm 1 that is movably suspended (using a surround 6 or the like) in a basket 2 for motion along central axis thereof, and a single motor 3 mounted on the basket that includes a voice coil 4 having a central axis 5 in substantial alignment with the central axis of diaphragm 1, which is coupled directly to the back of diaphragm 1 in order to move the diaphragm axially in response to an AC signal.

It is well known that as the size of the diaphragm increases and/or when more power is desired the size of the magnet required for driving the voice coil increases. Also, as the size of the diaphragm increases the size of the basket is increased, which in turn increases the profile (i.e. the front to back thickness) of the driver. Thus, woofers (drivers used for reproducing sound in the bass range, e.g. 20 Hz to 3000 Hz), which typically include larger diaphragms (compared to tweeters), require large motors and typically have larger profiles.

The profile of the driver directly affects the size of the speaker cabinet that receives the driver. A speaker cabinet that receives a woofer, therefore, requires a relatively large cabinet having a relatively large profile (i.e. front to back thickness).

SUMMARY OF THE INVENTION

It is an object of the present invention to provide a loudspeaker driver.

A loudspeaker driver according to the present invention includes a movable diaphragm having an open mouth defined by a terminal boundary residing at its outermost lateral edge and surrounding the entire interior surface area thereof, and a plurality of driver arrangements each including a voice coil suspended in a magnetic field, mechanically coupled to the movable diaphragm and disposed lateral to its outermost lateral edge.

Because of the arrangement in a loudspeaker driver according to the present invention, the diameter of the open mouth of the diaphragm does not necessarily lead to the enlargement of the profile (i.e. the front to back depth) of the driver.

Moreover, multiple motors of lower power rating each including a smaller magnet compared to a single motor having a power rating equal to the total power of the multiple motors can be used, which may lead to the reduction in the cost of a loudspeaker driver for a given power rating.

Other features and advantages of the present invention will become apparent from the following description of the invention which refers to the accompanying drawings.

DESCRIPTION OF THE EMBODIMENTS

Figure 1:
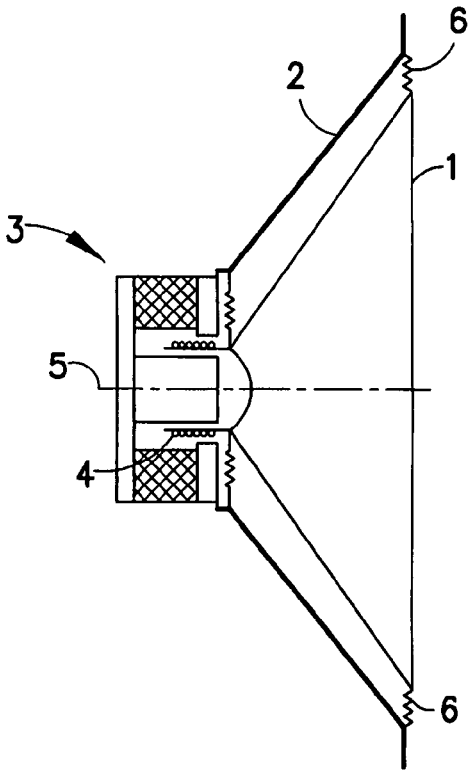
FIG.1 PRIOR ART
FIG. 1 illustrates a loudspeaker driver according to the prior art.

Unless otherwise indicated, it is intended for like numerals to identify like features in each embodiment disclosed herein. In the interest of brevity and efficiency in disclosing the invention like features are not repeatedly described. The presence of like features in each embodiment is clear, however, by reference numerals and the general appearance of like features in the attached figures.

Figure 2A:
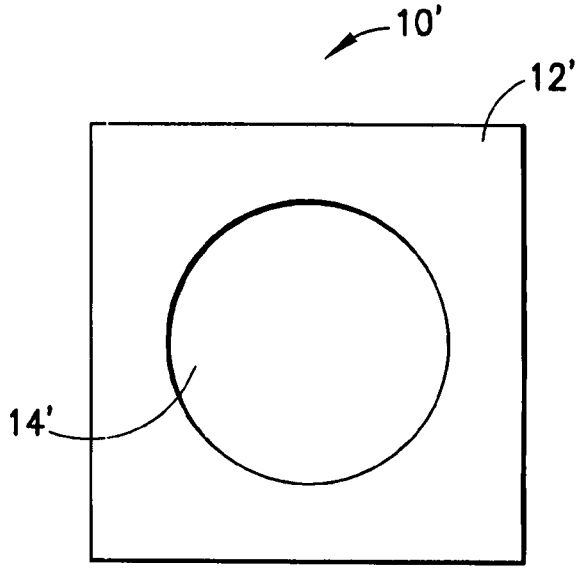
FIG. 2A is a front view of a speaker cabinet that includes a loudspeaker driver according to the present invention.
Figure 2B:
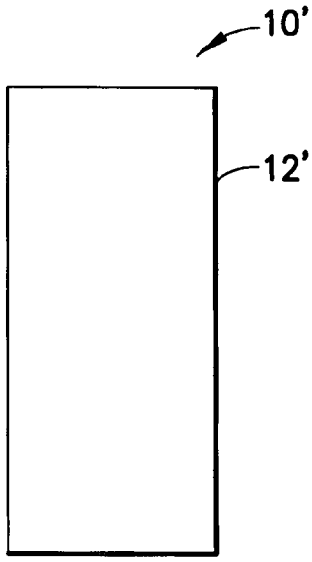
FIG. 2B is a side view of the speaker cabinet of FIG. 2A.

Referring to FIGS. 2A and 2B, a loudspeaker that includes a loudspeaker driver according to the present invention includes a speaker cabinet 10' having a front board 12' with a sound hole 14'. Cabinet 10' may be fully or partially enclosed. Specifically, speaker cabinet 10' may be an acoustic suspension speaker cabinet (fully enclosed) or a ported acoustic suspension cabinet, or the like. Cabinet 10' may be fabricated with medium density fiberboard (MDF), particle board, or any other suitable material.

Figure 3A:
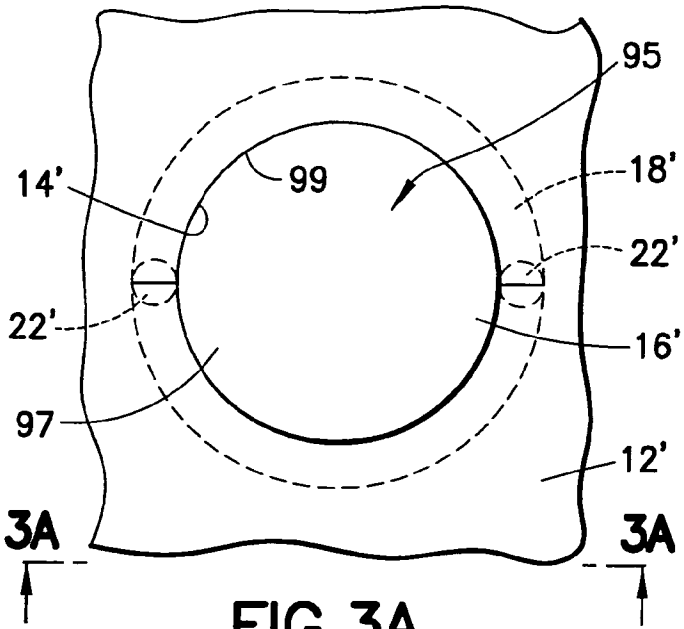
FIG. 3A shows a front (facing the outside of the cabinet) of a loudspeaker driver according to the first embodiment of the present invention.
Figure 3B:
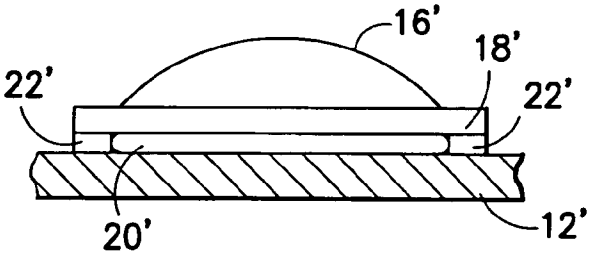
FIG. 3B shows a side view of the driver shown in FIG. 3A as seen along line 3A-3A in the direction of the arrows.
Figure 5C:
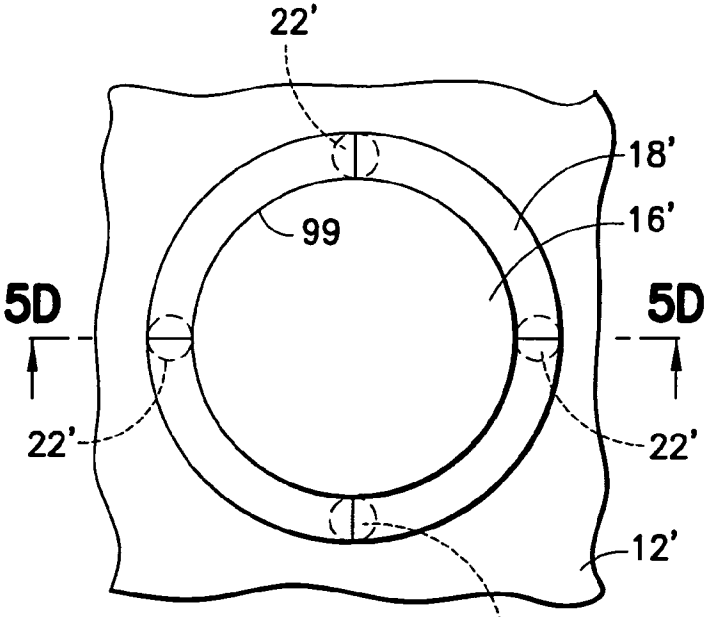
FIG. 5C shows a back (facing the interior of the cabinet) of the loudspeaker driver according to the second embodiment.
Figure 5D:
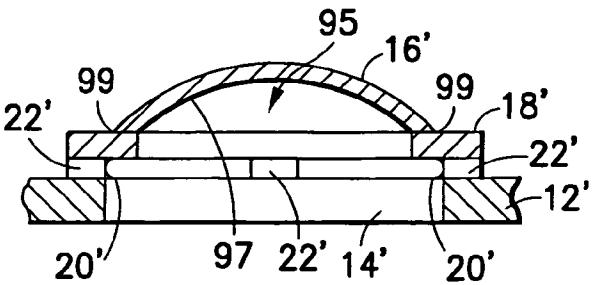
FIG. 5D is a cross-sectional view along line 5D-5D in FIG. 5C seen in the direction of the arrows.
Figure 3C:
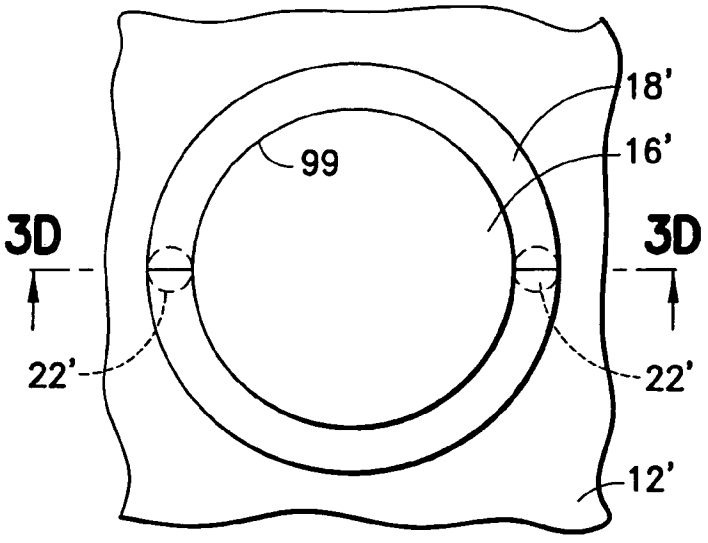
FIG. 3C shows a back (facing the interior of the cabinet) of a loudspeaker driver according to the first embodiment.
Figure 3D:
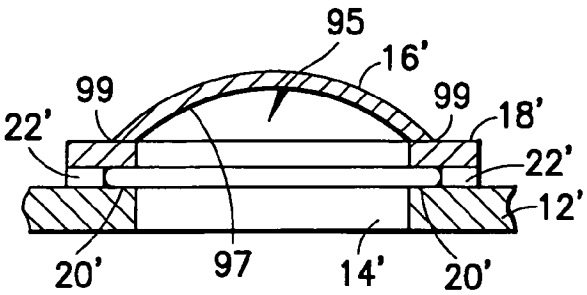
FIG. 3D is a cross-sectional view along line 3D-3D in FIG. 3C seen in the direction of the arrows.

Referring to FIGS. 3A and 3B, a loudspeaker driver according to the first embodiment of the present invention includes a diaphragm portion 16', a transmission portion (transmission frame) 18', which is preferably a ring, coupled to and disposed around the outer perimeter at the open mouth (described below) of diaphragm 16', a suspension member 20' which is fixed to the back side (the side facing the interior of cabinet 10') of front board 12' (serving as a support body) and transmission portion 18', and a plurality of preferably oppositely disposed drivers 22' each driver 22' being coupled between the backside of front board 12' and transmission portion 18'. The function of each driver 22' is to drive transmission portion 18' in a direction that is essentially perpendicular to front board 12'. Each driver 22' may be a transducer or a motor that includes a voice coil suspended in a magnetic field provided by a magnet, which may receive an electronic signal from a signal source such as an audio amplifier. Note that for the sake of simplicity the signal wires of the voice coils are not shown.

Figure 4A:
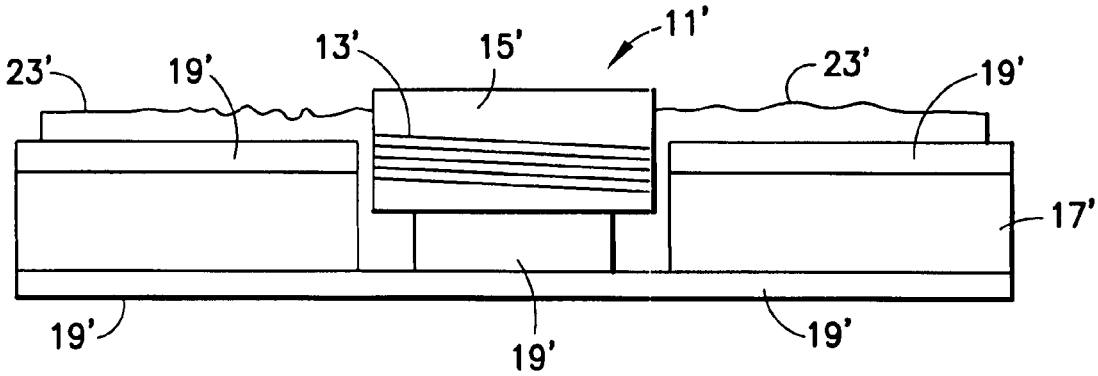
FIG. 4A shows an example of a motor arrangement for driving a voice coil in a loudspeaker driver according to the present invention.
Figure 4B:
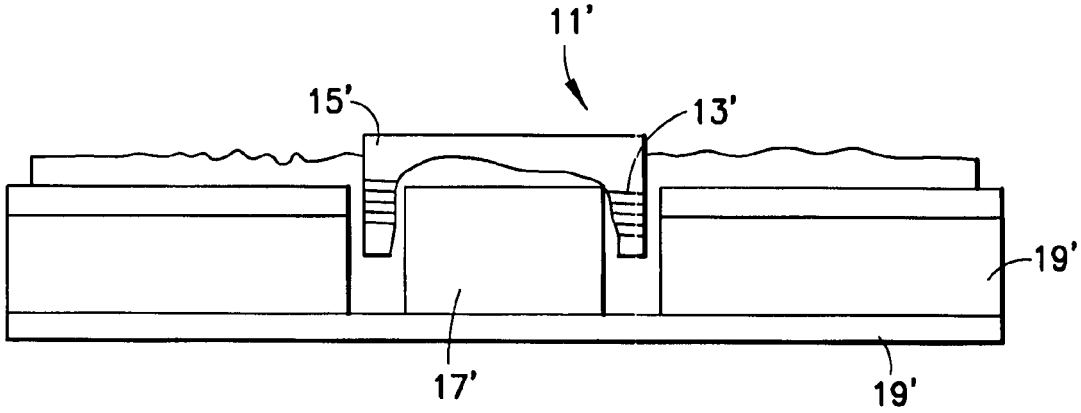
FIG. 4B shows another example of a motor arrangement for driving a voice coil in a loudspeaker driver according to the present invention.

Referring to FIGS. 4A and 4B, in the preferred embodiment, a voice coil arrangement suspended in a magnetic field is used as a driver 22'. Each voice coil 11' arrangement may be the same as those used in conventional loudspeaker drivers. Each voice coil 11', for example, includes a voice coil wire 13' that is wrapped around a bobbin 15' which can be induced to move by an AC signal when suspended in the magnetic field of a permanent magnet 17' projected by a magnetic circuit formed by metallic bodies 19' coupled to permanent magnet 17' similar to a conventional loudspeaker motor. Permanent magnet 17' is preferably coupled (directly or indirectly) to the back side (the surface facing the interior of the cabinet) of front board 12', and bobbin 15' of voice coil 11' may be attached to transmission portion 18', whereby voice coil 11' is suspended (in mid air) in the vicinity of and in the magnetic field of permanent magnet 17'. When operating, the electronic signals are transmitted to voice coil 11', which results in voice coil 11' being pushed away, or pulled toward permanent magnet 17'. Permanent magnet 17' may include an opening wide enough to receive the voice coil therein (FIG. 4A), or alternately, bobbin 15' may have an opening wide enough to receive magnet 17' (FIG. 4B). Note that each driver 22' may further include a spider 23' disposed around and coupled to voice coil 11' and attached to front board 12' or a metallic body 19' for additional stability.

Each voice coil 11' is suspended in mid air because of suspension 20'. Specifically, suspension 20' attaches transmission portion 18' to the back side of front board 12' such that the concave surface of diaphragm 16' faces outwardly (outside of cabinet 10') through sound hole 14'. Preferably, suspension 20' is disposed around sound hole 14' completely to prevent air from escaping cabinet 10'. Note that suspension 20' should be rigid enough so that it does not sag substantially under the weight of transmission portion 18', diaphragm 16', and voice coils 11'. However, diaphragm 16' should be compliant enough so that it will allow movement of transmission portion 18'. One suitable body for suspension 20' may be an incomplete tube (a tube which has a portion thereof removed lengthwise) made from a flexible polymer such as silicone. A full tube may also work if it satisfies the criteria set forth above. Other suspension materials used in conventional loudspeakers may also be used without deviating from the scope and the spirit of the present invention. Such conventional suspensions are typically made from paper based materials, reinforced fabric or foam.

Note that diaphragm 16' is shown to be a semisphere (not quite a hemisphere) having preferably a circular open mouth (as defined below) the circumference of which is the outer perimeter that is fixed to transmission portion 18'. Diaphragm 16' may be made from a paper based material used for forming conventional diaphragms. It has also been found that Styrofoam based materials may be suitable. Note that transmission portion 18' may be made of the same material as diaphragm 16'. That is, diaphragm 16' and transmission portion 18' may be a unitary body. For example, as shown, transmission portion 18' may flange outwardly from the circumference of the mouth of diaphragm 16'. Transmission portion 18' and diaphragm 16' may be made from different materials and fixed to one another using any suitable method—for example, adhesively joined—without deviating from the scope and the spirit of the present invention. Note that the joint between diaphragm 16' and transmission portion 18' does not allow free flow of air to ensure air is pushed efficiently by diaphragm 16'.

Note further that drivers 22' are preferably aligned along the diameter of the circular mouth of diaphragm 16' in order to ensure even movement of diaphragm 16' along an axis that is perpendicular to front board 12'.

Figure 5A:
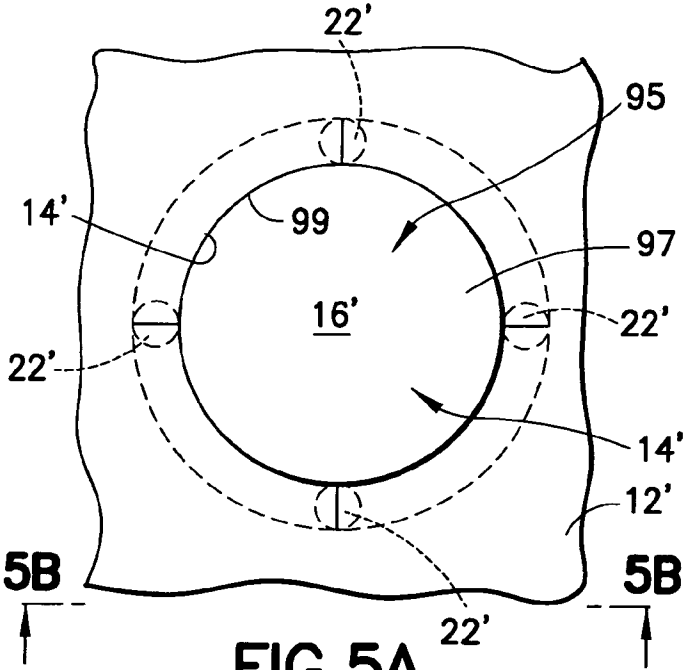
FIG. 5A shows a front (facing the outside of the cabinet) of a loudspeaker driver according to the second embodiment of the present invention.
Figure 5B:
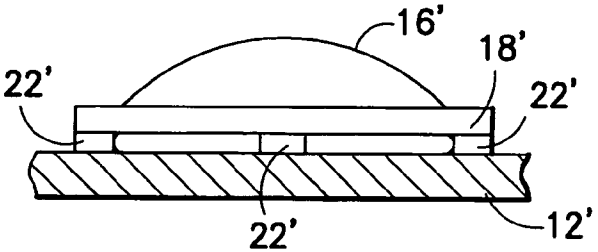
FIG. 5B shows a side view of the loudspeaker driver shown in FIG. 5A as seen along line 5B-5B in the direction of the arrows.

Referring now to FIGS. 5A and 5B, in a second embodiment of the present invention, four drivers 22' are used instead of two. Each pair of drivers 22' lie along a diameter of the circular base (open mouth as defined below) of diaphragm 16'. Also, drivers 22' are evenly spaced angularly (ninety degree apart in this case) in order to ensure even driving movement of diaphragm 16'.

Note that a speaker arrangement according to the present invention is not limited to two or four drivers 22', and that three drivers 22' or more than four drivers 22' can be added as needed without deviating from the scope and the spirit of the present invention.

Figure 6B:
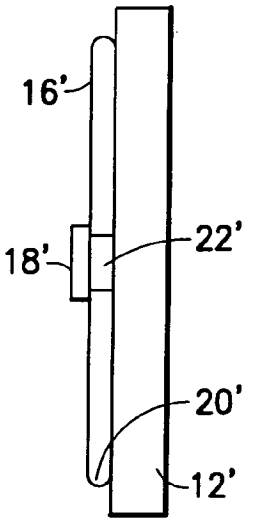
FIG. 6B is a side view along line 6B-6B in the direction of the arrows.
Figure 6A:
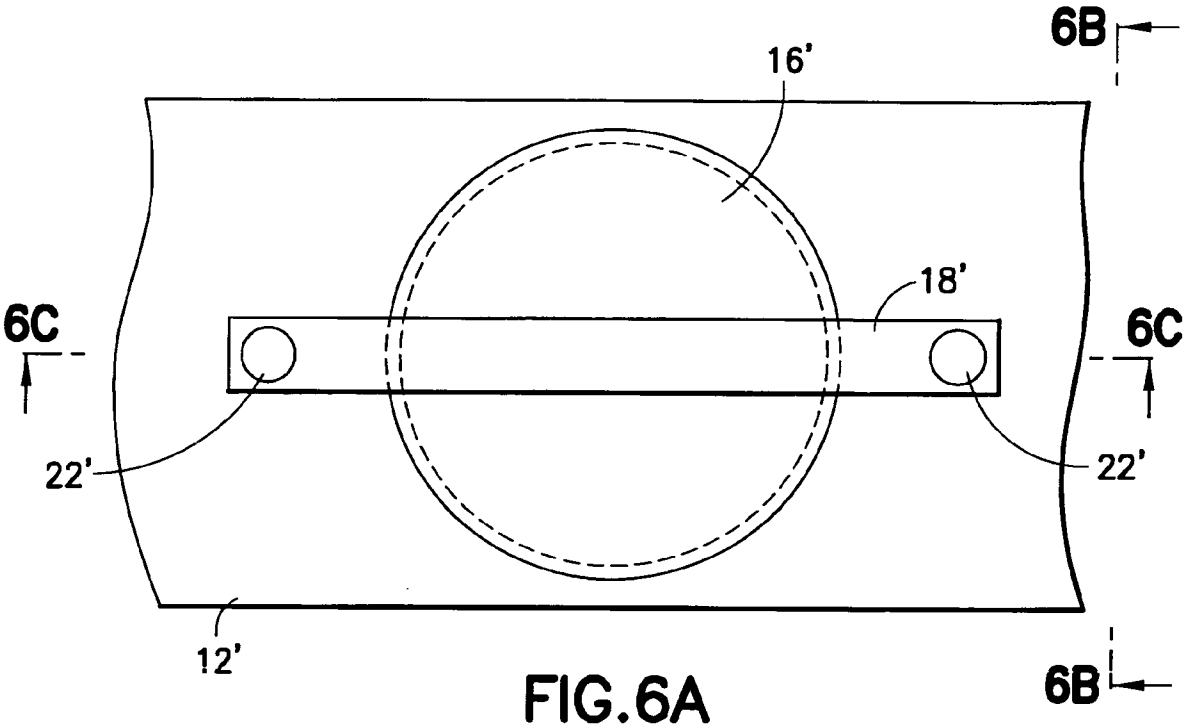
FIG. 6A shows a back view of a loudspeaker driver according to the third embodiment.
Figure 6C:
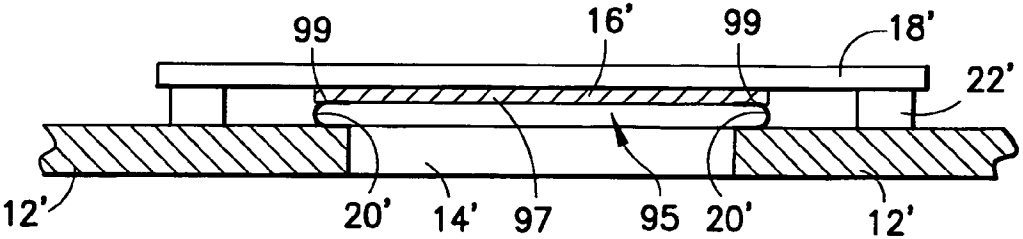
FIG. 6C is a cross-sectional view along line 6C-6C in the direction of the arrows.

Referring to FIGS. 6A-6C, in a third embodiment of the present invention, a transmission portion 18' is attached to the back of diaphragm 16', and each driver 22' is attached to either end of transmission portion 18'. In this embodiment, transmission frame 18' is an elongated rigid body that is capable of transmitting motion from drivers 22' to the back of diaphragm 16'. In alternative embodiments more than two drivers 22' can be used. For example, a cross-shaped transmission frame 18' may be used with four drivers 22' each disposed at a free end of the cross.

Figure 7:
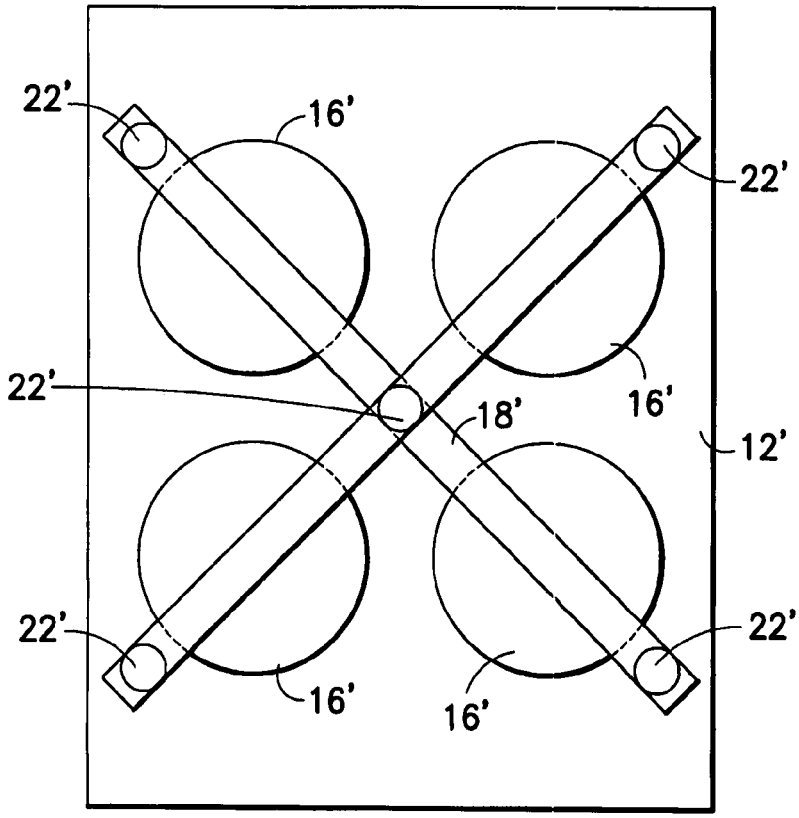
FIG. 7 is a back view of a loudspeaker driver according to the fourth embodiment.

Referring to FIG. 7, in a fourth embodiment, transmission portion 18' may be a cross-shaped body that is attached to the back of a plurality of diaphragms 16' (illustrated in abstract by a cross-like marking) and driven by a plurality of drivers 22' as shown.

Figure 8:
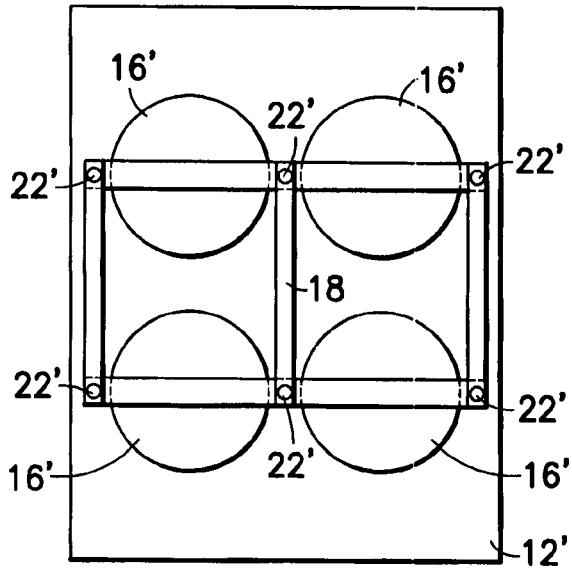
FIG. 8 is a back view of a loudspeaker driver according to the fifth embodiment.

Referring to FIG. 8, in a fifth embodiment of the present invention, transmission portion 18' is a lattice-shaped body that is attached to the back of a plurality of diaphragms 16', and driven by a plurality of drivers 22'.

A speaker arrangement according to the present invention is advantageous in that it can have a plurality of lower power rated drivers delivering the same power as a higher power rated speaker. For example, two 25 watt drivers can be used to replace a 50 watt driver.

Furthermore, due to the multi-driver arrangement, it is now possible to turn some of the drivers off or on selectively. Thus, the speaker power rating can be changed as desired.

It should be noted that drivers 22' and suspension 20' need not be mounted on front board 12' directly. Rather, a flat board or the like may be provided as a platform for receiving drivers 22' and suspension 20' and the board can then be mounted on the back surface of front board 12'. The board should include an opening that coincides with sound hole 14'.

It should also be noted that a loudspeaker driver according to the present invention is not limited to a cabinet environment, but may be adapted to other enclosures without deviating from the scope and the spirit of the present invention.

The voice coils in a loudspeaker driver according to the present invention may be series connected or parallel connected and connected together to a single AC source in order to operate in unison. Alternatively, one or more of the voice coils can be connected to a different AC source than the others, whereby the voice coils can be operated independently.

Figure 9:
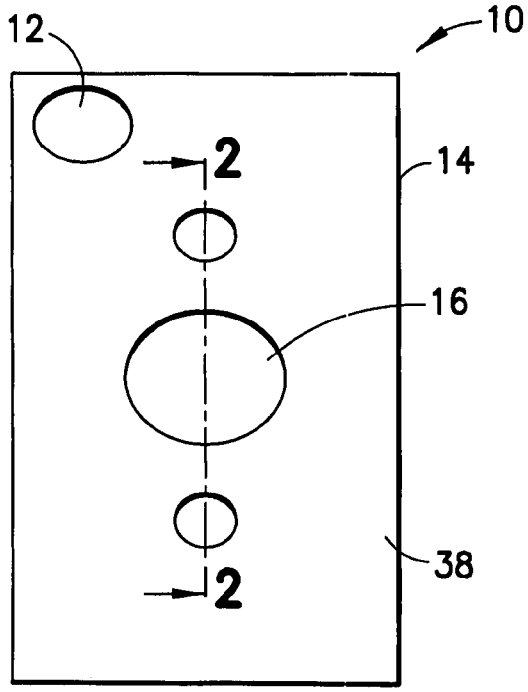
FIG. 9 illustrates a front plan view of another loudspeaker that includes a loudspeaker driver according to the present invention.

FIG. 9 illustrates a front plan view of a loudspeaker 10 that includes a loudspeaker driver arrangement according to the fifth embodiment of the present invention. For illustrative purposes loudspeaker 10 is a two way system that includes a tweeter 12 as well as a loudspeaker driver according to the present invention mounted in a closed cabinet 14. It should be understood that a loudspeaker according to the present invention is not limited to two way systems, but may be a three way system or only include a loudspeaker driver according to the present invention. Furthermore, a loudspeaker according to the present invention is not limited to sealed cabinet type arrangements, but may be implemented in other arrangements, for example, ported cabinets.

Figure 10A:
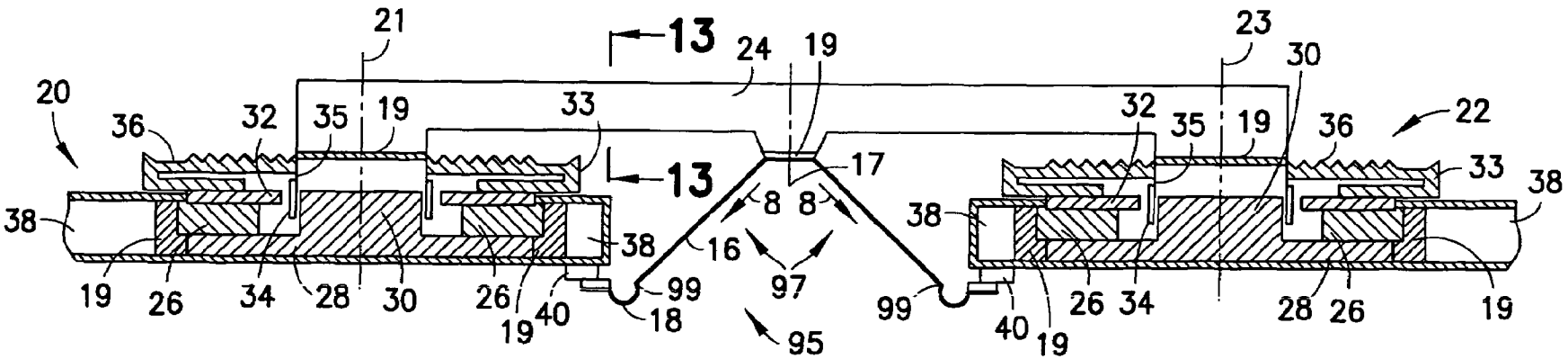
FIG. 10A illustrates a cross-sectional view of a loudspeaker driver according to an embodiment of the present invention as would be seen along line 2-2 viewed in the direction of the arrows.

Referring to FIG. 10A, which illustrates a cross-sectional view of a driver according to the present invention as would be seen along line 2-2, a loudspeaker driver according to the present invention includes a diaphragm 16 received in a diaphragm opening in front board 38 (serving as a support body) of cabinet 14, which is cone-shaped and made from any appropriate material such as paper, a surround 18, two motors 20, 22, and a transmission frame 24 operatively coupled to motors 20, 22 and diaphragm 16, whereby diaphragm 16 can be moved along its central axis 17 in order to generate sound waves.

According to one aspect of the present invention, each motor 20, 22 is disposed lateral to and outside the outer boundaries of diaphragm 16. Preferably, the axis of motion 21, 23 of each motor 20, 22 is parallel to the central axis 17 of diaphragm 16.

Each motor 20,22 preferably includes a magnet 26, a back plate 28, a center pole piece 30 extending through a central opening in magnet 26, a top plate 32, a coil 34 wound around a former (bobbin) 35, and a spider 36. Spider 36 includes a central opening which receives and is coupled to former 35 and is secured to top plate 32 directly or indirectly (through a base plate 33 attached to top plate 32), whereby coil 34 is suspended in the magnetic field present in the gap between a top portion of pole piece 30 and top plate 32. Each motor 20, 22 operates in the conventional manner. That is, by applying an AC signal to a coil 34, coil 34 and former 35 move along motion axis 21, 23 of the motor.

According to one aspect of the present invention, each end of transmission frame 24 is mechanically secured to a former 35 through an adhesive body 19 formed with, for example, an epoxy glue, and a middle portion of transmission frame 24 is mechanically secured to a central portion of the back of (the surface facing the interior of cabinet 12) diaphragm 16 also through an adhesive body formed with, for example, epoxy glue or the like.

In this embodiment of the present invention, each motor 20,22 is received in a respective opening in the front board 38 of cabinet 12 and mechanically secured to front board 38. One preferred way to secure each motor 20, 22 is through the use of an adhesive such as glue. Further, note that in this embodiment each motor 20,22 is exposed through a respective opening in front board 38. Preferably, the back of each motor 20, 22 is coplanar with the front surface (the surface of the exterior of front board 38) of front board 38 as illustrated by FIG. 10A.

Figure 10B:
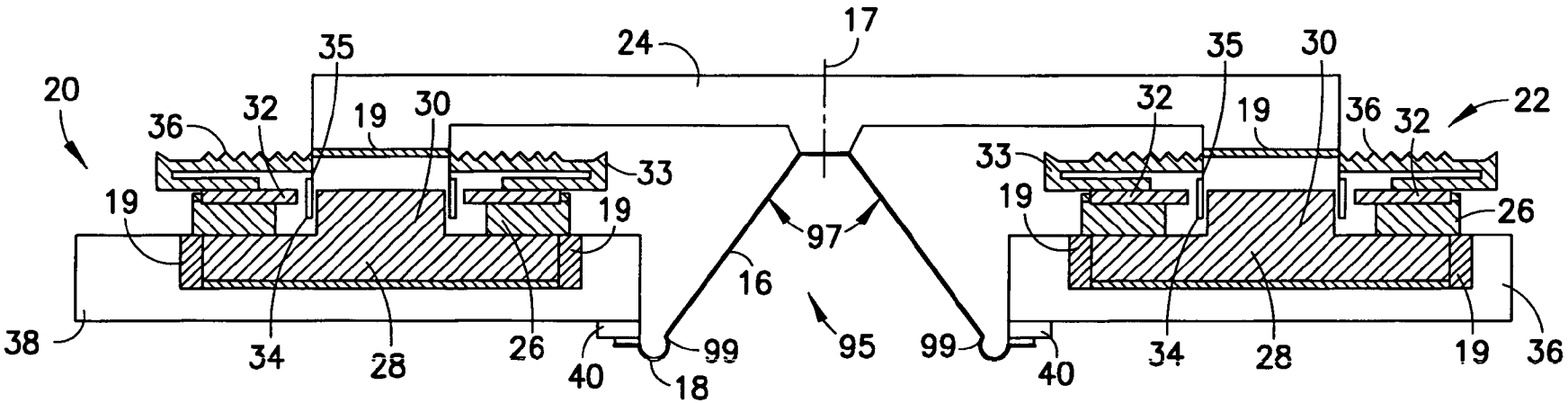
FIG. 10B illustrates a cross-sectional view of a loudspeaker driver according to an embodiment of the present invention as would be seen along line 2-2 viewed in the direction of the arrows.

Referring to FIG. 10B, note that it may not be necessary to have a through opening in front board 38 for receiving a motor, and each motor 20, 22 may be received instead in a respective recess (which extends only partially through the body of front board 38) in front board 38 and then secured to front board 38 with glue 19 or the like without deviating from the scope and spirit of the present invention.

In the first variation of the fifth embodiment, surround 18 is adhesively attached to a frame 40. Frame 40 is then secured to front face of front board 38 with screws or the like mounting hardware. Frame 40 is preferably a metallic or plastic ring which receives in the interior opening thereof diaphragm 16, and is attached to front face of the front board 38 by screws or the like.

Figure 11A:
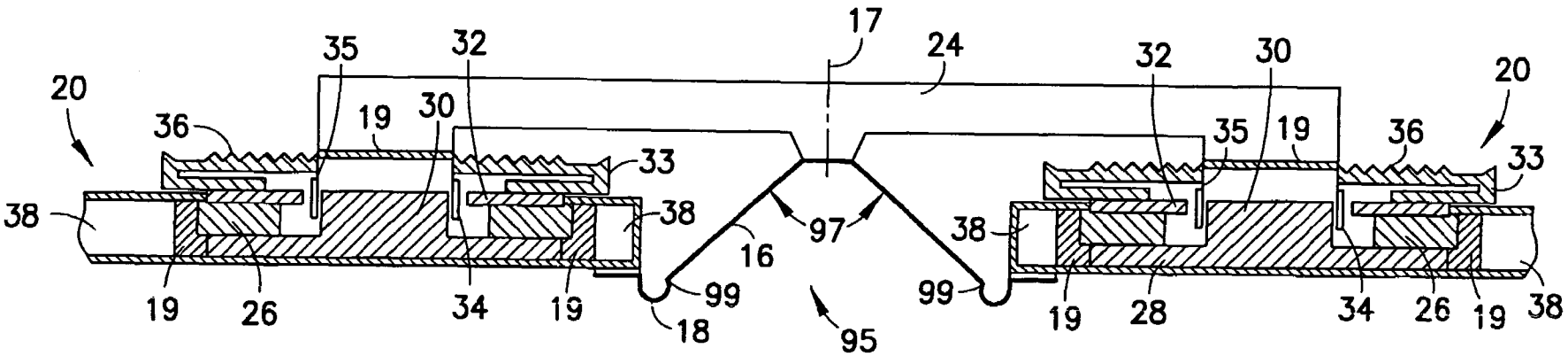
FIG. 11A illustrates a cross-sectional view of a loudspeaker driver according to an embodiment of the present invention as would be seen along line 2-2 viewed in the direction of the arrows.
Figure 11B:
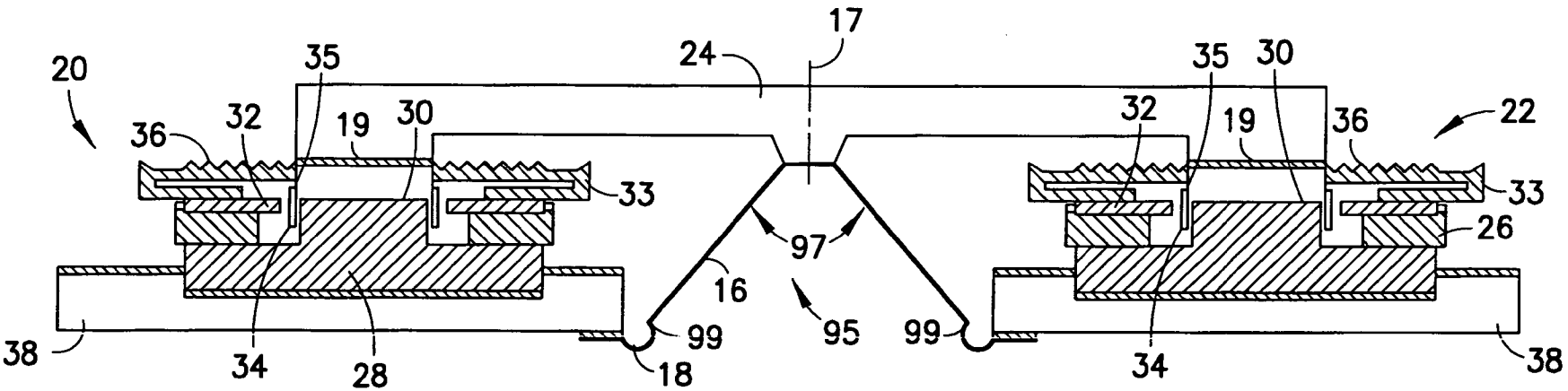
FIG. 11B illustrates a cross-sectional view of a loudspeaker driver according to an embodiment of the present invention as would be seen along line 2-2 viewed in the direction of the arrows.

Referring to FIG. 11A, which illustrates another variation of the fifth embodiment, surround 18 is secured directly to front face of front board 38, for example, by glue or the like adhesive. FIG. 11B shows the same variation except in this variation each motor 20,22 is received inside a recess which extends only partially through the body of front board 38.

Figure 12:
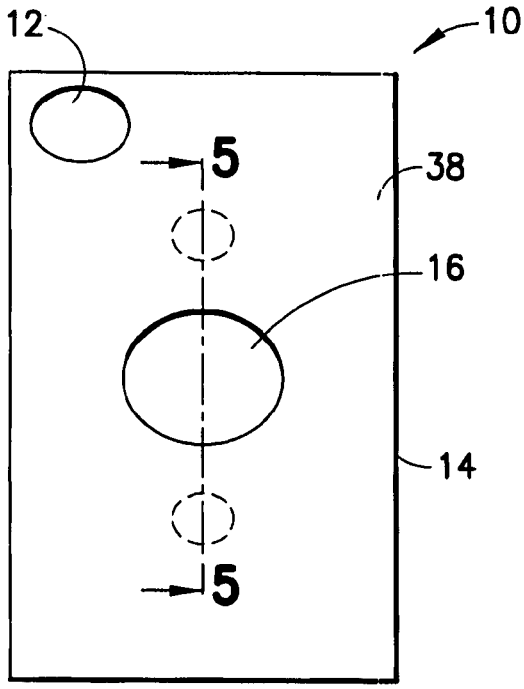
FIG. 12 illustrates a front plan view of a loudspeaker that includes a loudspeaker driver according to the present invention.
Figure 13:
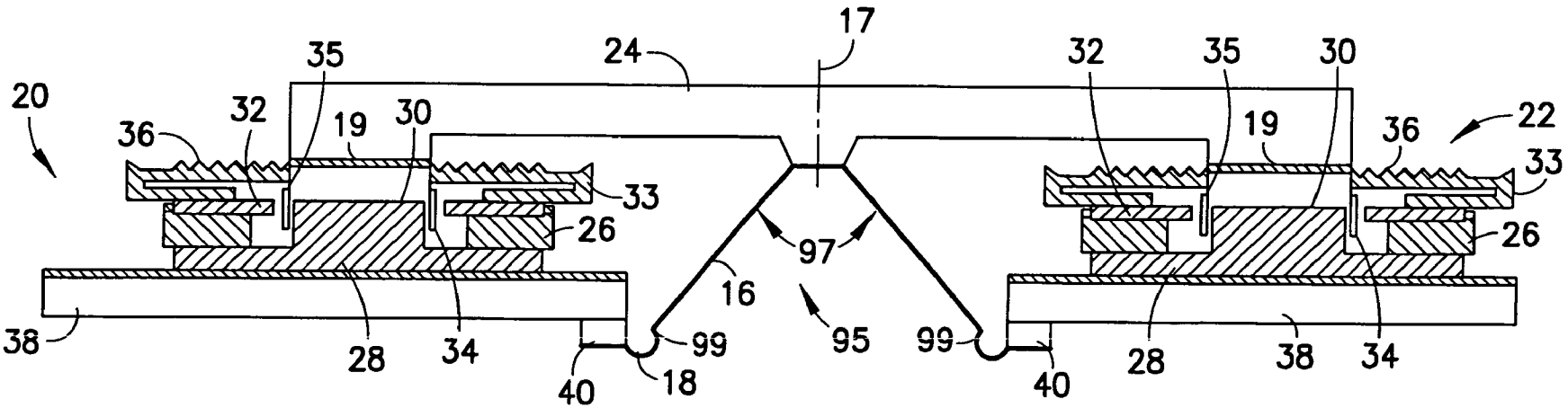
FIG. 13 illustrates a cross-sectional view of a loudspeaker driver according to an embodiment of the present invention as would be seen along line 5-5 viewed in the direction of the arrows.
Figure 14:
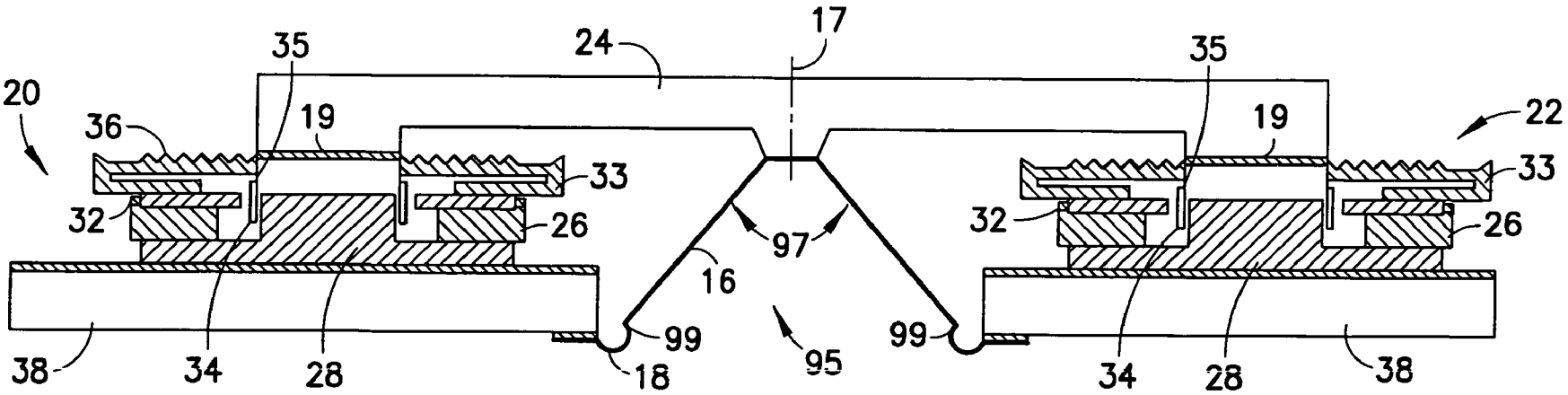
FIG. 14 illustrates a cross-sectional view of a loudspeaker driver according to an embodiment of the present invention as would be seen along line 5-5 viewed in the direction of the arrows.

Referring now to FIGS. 12 and 13, in which like numerals identify like features, in a loudspeaker driver according to the sixth embodiment of the present invention each motor 20, 22 is disposed on and secured to the back surface (the surface facing the interior of the cabinet) of front board 38. Glue or the like adhesive may be used to secure each motor in the manner described. FIG. 13 illustrates a variation in which a frame 40 (similar to frame 40 in the previous embodiment) is used to secure surround 18 to the front surface of front board 38. Referring to FIG. 14, in which like numerals identify like features, in another variation of the sixth embodiment surround 18 is secured to front board 38 directly with an adhesive such as glue or the like without an intervening frame 40.

Figure 15:
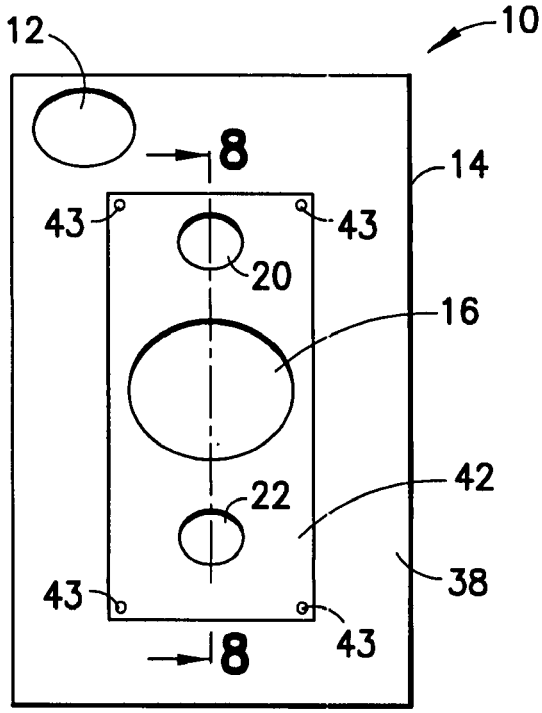
FIG. 15 illustrates a front plan view of a loudspeaker that includes a loudspeaker driver according to the present invention.
Figure 16:
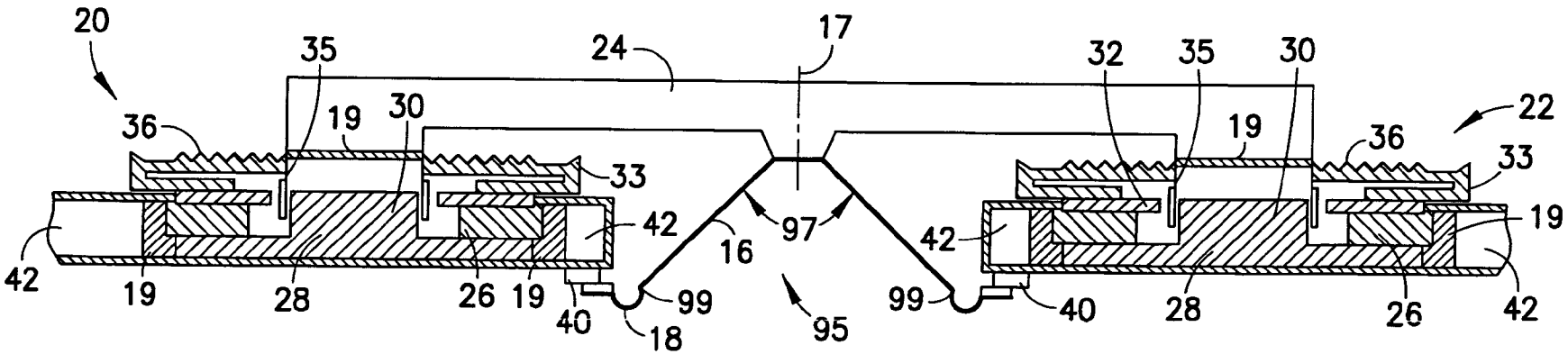
FIG. 16 illustrates a cross-sectional view of a loudspeaker driver according to an embodiment of the present invention as would be seen along line 8-8 viewed in the direction of the arrows.
Figure 17A:
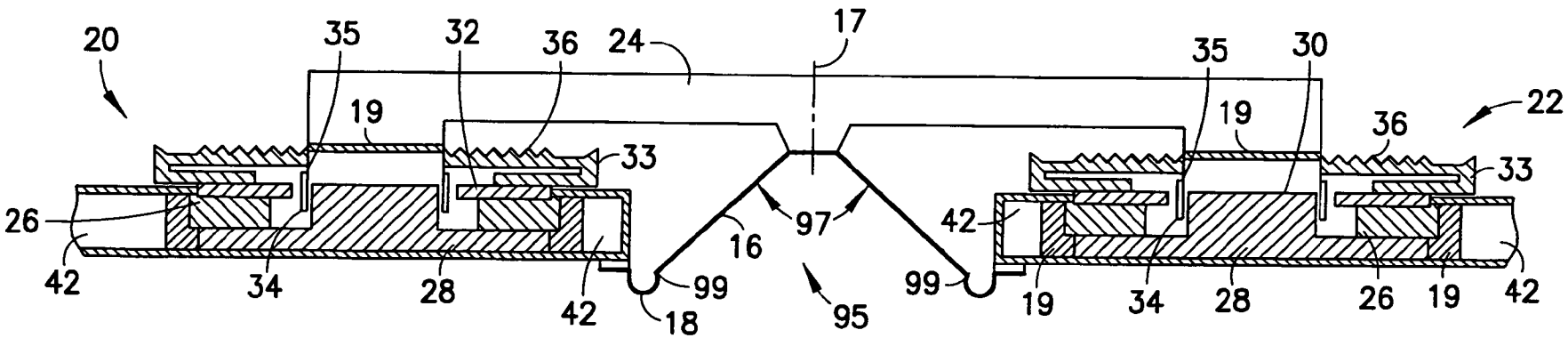
FIG. 17A illustrates a cross-sectional view of a loudspeaker driver according to an embodiment of the present invention as would be seen along line 8-8 viewed in the direction of the arrows.

Referring now to FIGS. 15 and 16, a loudspeaker driver according to the seventh embodiment includes a support frame 42 (serving as a support body instead of the front board of the cabinet). Support frame 42 may be stamped out of a sheet of metal of an appropriate thickness and includes openings for receiving motors 20,22. Thus, unlike the fifth and the sixth embodiments, a loudspeaker driver according to the seventh embodiment is not assembled on front board 38 of the cabinet. Rather, it is assembled onto support frame 42 (using an adhesive such as glue, or if appropriate through welding or brazing). Support frame 42 is then secured mechanically to front board 38 using, for example, screws 43 or the like mounting hardware. Note that in the variation shown by FIG. 16 surround 18 is secured to support frame 42 using a frame 40 (similar to frame 40 described above). Note that front board 38 is opened to receive the driver arrangement inside cabinet 12, thereby allowing the free motion of diaphragm 16. Referring now to FIG. 17A, alternatively, surround 18 may be adhesively attached using glue or the like to support frame 42 directly.

Figure 17B:
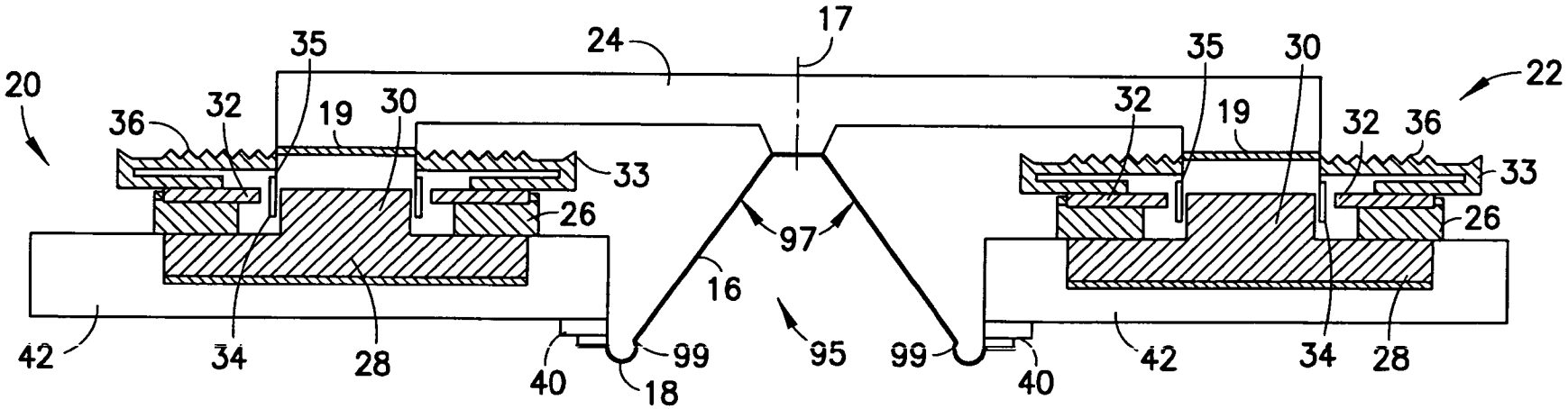
FIG. 17B illustrates a cross-sectional view of a loudspeaker driver according to an embodiment of the present invention as would be seen along line 8-8 viewed in the direction of the arrows.
Figure 17C:
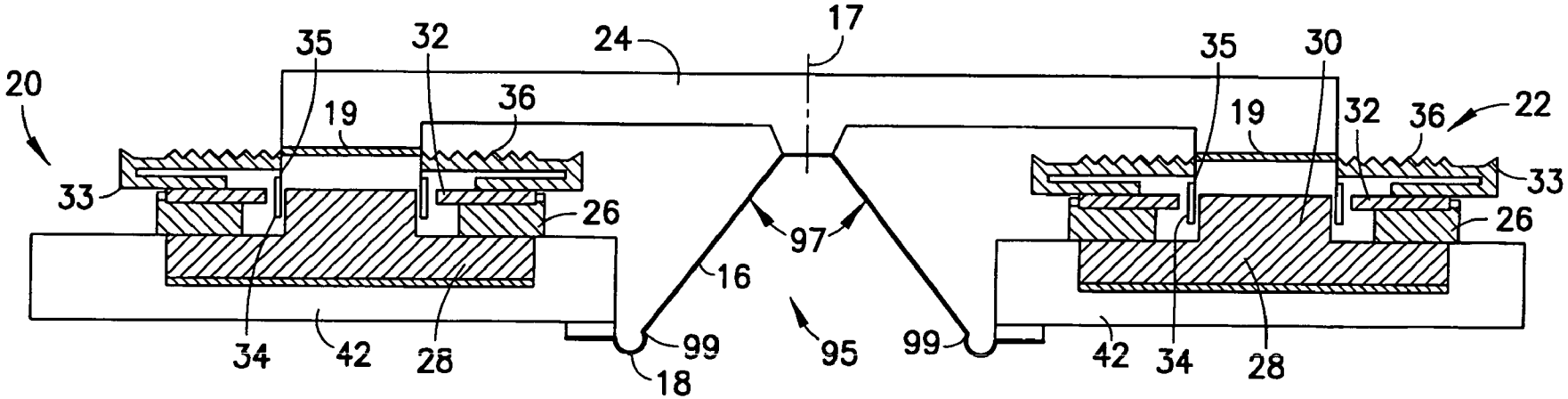
FIG. 17C illustrates a cross-sectional view of a loudspeaker driver according to an embodiment of the present invention as would be seen along line 8-8 viewed in the direction of the arrows.

Note that openings are not required in frame 42, rather a recess may be provided to receive each motor 20,22, without allowing the back surface of each motor to be exposed. FIGS. 17B and 17C illustrate such variations. FIG. 17B shows an example with frame 40 and FIG. 17C shows an example without frame 40 in which surround 18 is directly attached to frame 42 using glue or the like.

Figure 18:
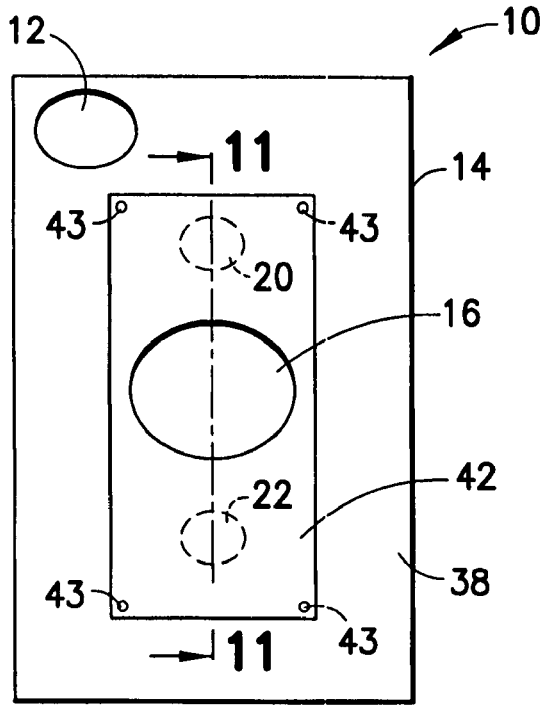
FIG. 18 illustrates a front plan view of a loudspeaker that includes a loudspeaker driver according to the present invention.
Figure 19:
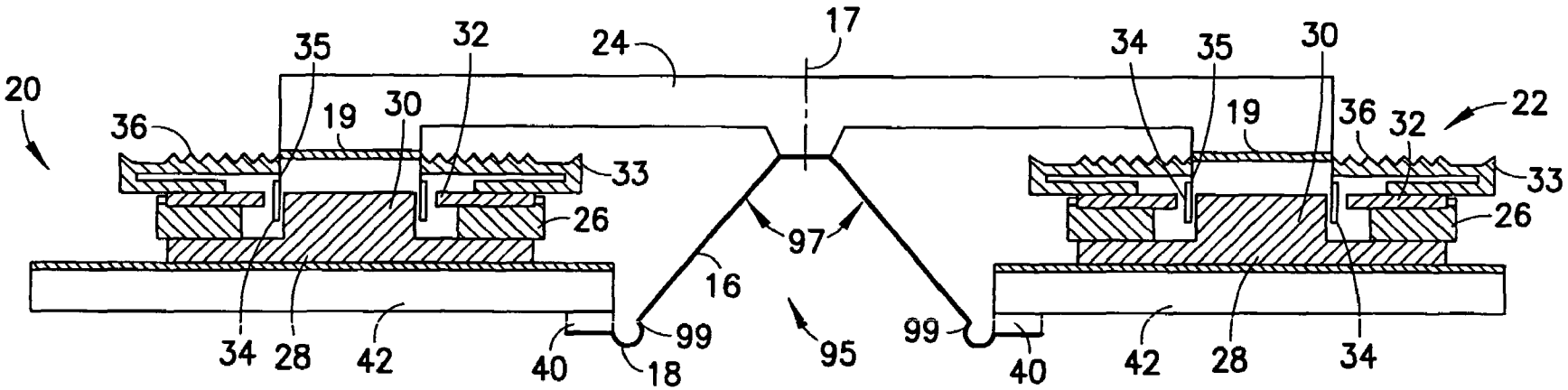
FIG. 19 illustrates a cross-sectional view of a loudspeaker driver according to an embodiment of the present invention as would be seen along line 11-11 viewed in the direction of the arrows.

Referring now to FIGS. 18 and 19, in which like numerals identify like features, a loudspeaker driver according to the eighth embodiment of the present invention includes motors 20,22 attached to a back surface of support frame 42. Thus, unlike the seventh embodiment, openings are not required to receive each motor 20,22.

Figure 20:
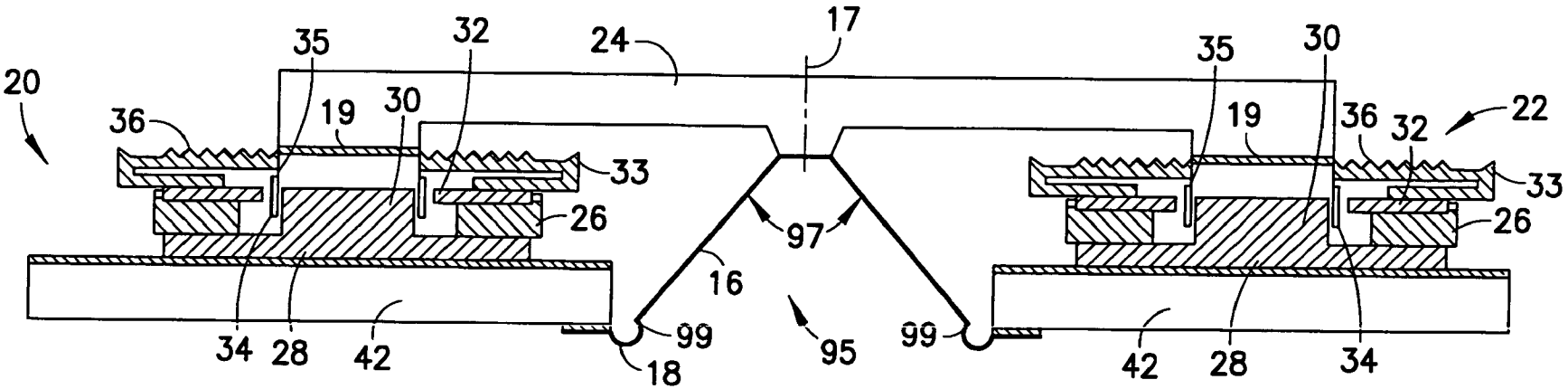
FIG. 20 illustrates a cross-sectional view of a loudspeaker driver according to an embodiment of the present invention as would be seen along line 8-8 viewed in the direction of the arrows.

Note that in the variation shown by FIG. 19, surround 18 is secured to support frame 42 using a frame 40 (similar to frame 40 described above). FIG. 20 shows another variation in which surround 18 is adhesively attached using glue or the like to support frame 42 directly.

Figure 21:
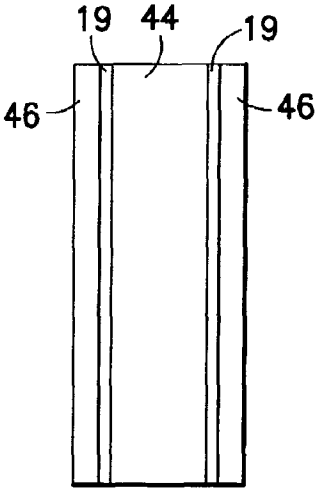
FIG. 21 is a cross-sectional view of transmission frame 24 along line 13-13 (FIG. 10A) viewed in the direction of the arrows.

Referring to FIG. 21, in the preferred embodiment of the present invention, transmission frame 24 includes a soft core 44, and a relatively rigid outer clad 46 on each side thereof and attached thereto with glue or the like adhesive 19. The soft core 44 may be made from foam board (e.g. foam board sold under the U.S. registered trademark FOME-COR) or the like material while outer clad 26 may be made from a sheet of aluminum or the like material. It has been found that such an arrangement provides high rigidity and is light enough to serve as an appropriate transmission frame 24 particularly when transmission frame 24 is coupled to diaphragm 16 such that axis 17 is parallel to the plane that run parallel to soft core 44, and clads 46. It has also been found that such an arrangement does not exhibit excessive vibration that my color the reproduction of sound.

Figure 22B:
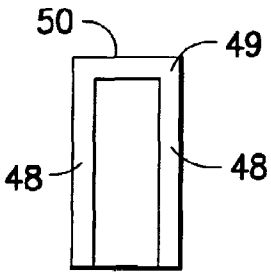
FIG. 22B shows a cross-sectional view of the transmission frame of FIG. 22A along line 14B-14B viewed in the direction of the arrows.
Figure 22A:
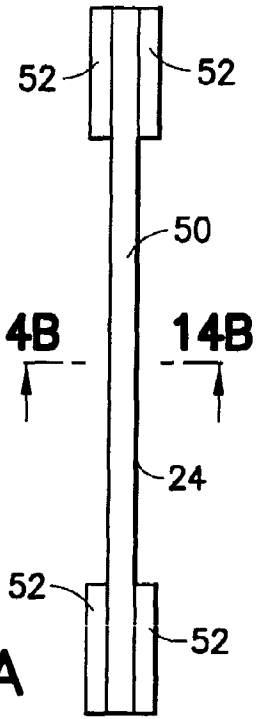
FIG. 22A illustrates a top plan view of another transmission frame.

Referring to FIGS. 22A and 22B, a transmission frame 24 according to an alternative design may include a metallic sheet, e.g. aluminum sheet 49, bent (see FIG. 22B) through stamping or the like to have two parallel walls 48 linked through a central spine portion 50. The space between parallel walls 48 may or may not be filled with a soft core such as foam board or the like material. Note that transmission frame 24 according to the variation shown by FIG. 22A includes feet portions 52 at each end thereof. Each feet 52 may provide additional surface area for attachment to a respective former of a voice coil.

Figure 23A:
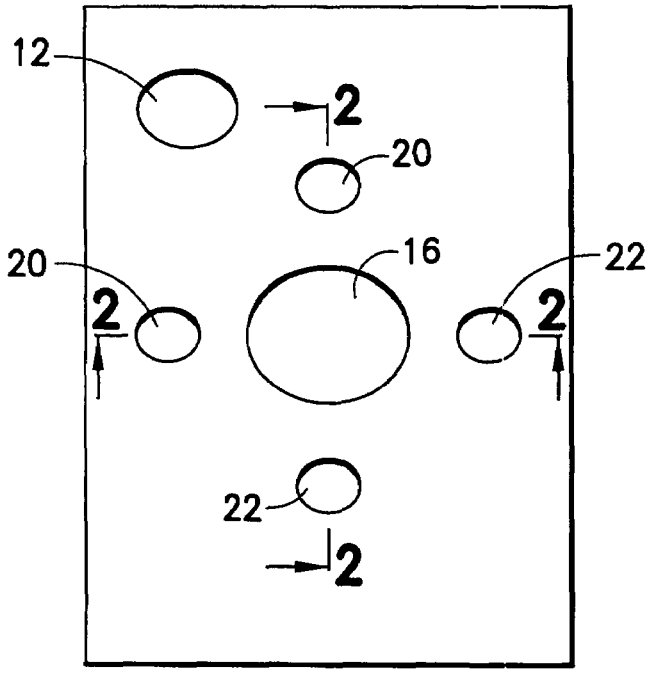
FIG. 23A shows a front plan view of a speaker that includes a loudspeaker driver according to the present invention.
Figure 23B:
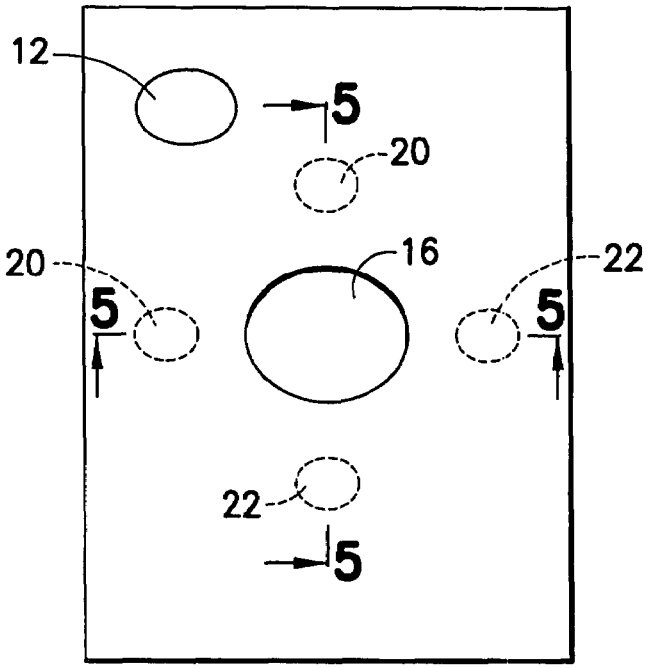
FIG. 23B shows a front plan view of a speaker that includes a loudspeaker driver according to the present invention.

Referring to FIGS. 23A and 23B, it should be noted that a loudspeaker driver according to the present invention may include more than two motors. For example, a loudspeaker driver according to the present invention may include a driver with four motors coupled to a diaphragm through a transmission frame as described above without deviating from the present invention.

Figure 24A:
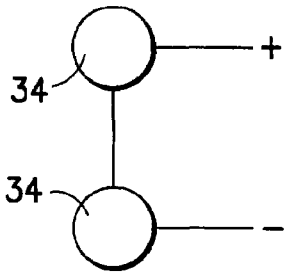
FIGS. 24A-24E illustrate various wiring configurations for the coils of a multi-motor loudspeaker driver according to the present invention.
Figure 24B:
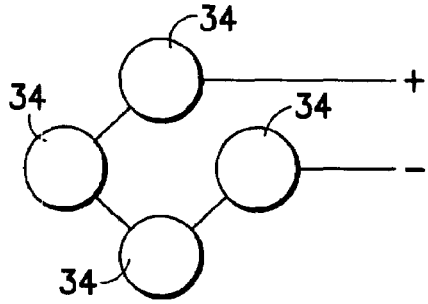
Figure 24C:
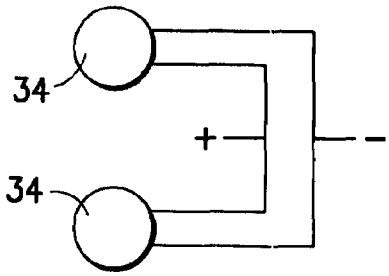
Figure 24E:
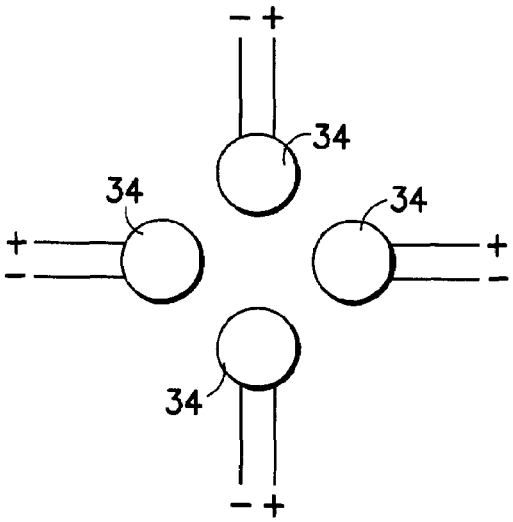
Figure 24D:
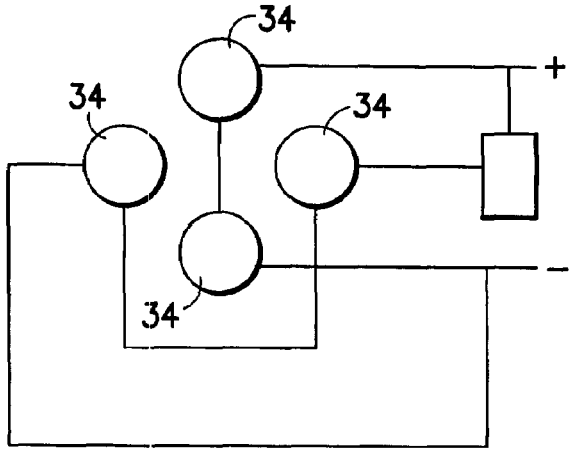

The coils in each motor in a multi-motor driver according to the present invention may be series connected as illustrated by FIG. 24A (a loudspeaker driver with two motors) and FIG. 24B (four motors), parallel connected (FIG. 24C), a combination of two series connected two motor circuits parallel connected (FIG. 24D), or each motor can be individually connected to a signal source without being connected to another motor (FIG. 24E).

One advantage of a driver arrangement according to the present invention is that the same mechanical power can be transmitted to the diaphragm using two or more smaller motors as a single large motor. Given that large magnets are expensive, the cost of the loudspeaker driver may be reduced without sacrificing performance.

Another advantage of the present invention is that the depth of the loudspeaker driver can be reduced thus allowing the depth of the cabinet to be reduced. As a result low profile (thickness) speaker cabinets can be used with a loudspeaker driver according to the present invention.

Moreover, a driver arrangement according to the present invention allows for widening the diaphragm without increasing the depth of the driver. Thus, a driver having a large area diaphragm can have the same depth as a smaller area diaphragm.

Figure 25:
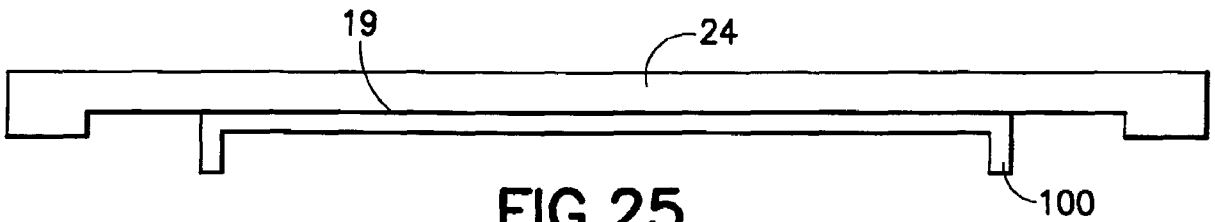
FIG. 25 illustrates a cylindrical diaphragm in combination with a transmission frame according to another embodiment of the present invention.

FIG. 25 illustrates a cylindrical diaphragm 100 in combination with a transmission frame 24 according to the present invention which can replace the combination of a cone-shaped diaphragm and a transmission frame 24 in each embodiment disclosed herein. The replacement of a cone-shaped diaphragm with a cylindrical diaphragm 100 allows for more volume of air to be moved without changing the diameter given an equal height. Furthermore, it may allow for the same volume of air that is moved by a cone of a certain diameter with a shallower depth. Thus, the height of the diaphragm and transmission frame combination may be reduced, thereby allowing for further reduction of the depth of the loudspeaker driver. Note also that frame 24 may be connected with adhesive 19 or the like to a larger area at the back surface of the cylindrical diaphragm 100 which may result in a more secure coupling and better transmission of the mechanical force from motors 20, 22 to cylindrical diaphragm 100.

Note that in a driver according to the present invention it is preferred to not have a motor arranged at the back (the side facing the interior of the cabinet) of the diaphragm as is the case in prior art loudspeaker drivers in order to obtain as shallow a profile as possible.

Note further that according to the present invention, in each embodiment disclosed herein, the voice coil of each driver that is suspended in a magnetic field is disposed lateral to and outside the open mouth of the diaphragm. The open mouth of the diaphragm in each embodiment is defined by a terminal boundary 99 residing at the outermost lateral edge of the diaphragm (which in some embodiments shown herein is coupled to the surround/suspension) surrounding the entire interior surface area 97 of the diaphragm. Thus, each voice coil in each embodiment disclosed herein is disposed lateral to and outside of the interior region 95 defined by the outermost edge of the diaphragm.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A loudspeaker driver, comprising: a movable diaphragm having an open mouth defined by a terminal boundary residing at the outermost lateral edge of said diaphragm surrounding the entire interior surface area of said diaphragm; and a plurality of driver arrangements residing lateral to and outside said open mouth and each including a voice coil suspended in a magnetic field of a respective magnet, each voice coil being mechanically coupled to said movable diaphragm and each driver arrangement including a motion axis disposed lateral to and outside said outermost lateral edge of said movable diaphragm, wherein each voice coil is movable along a respective motion axis of a respective driver arrangement.

2. The loudspeaker driver of claim 1, further comprising a transmission body mechanically coupled to said diaphragm and said voice coils to transmit force from said voice coils to said diaphragm.

3. The loudspeaker driver of claim 2, wherein said transmission body is mechanically coupled to said terminal boundary of said diaphragm.

4. The loudspeaker driver of claim 2, wherein said transmission body is mechanically coupled to a back surface of said diaphragm.

5. The loudspeaker driver of claim 2, wherein said transmission body includes a soft inner core and rigid cladding on at least one exterior surface of said soft inner core.

6. The loudspeaker driver of claim 1, further comprising a support body, said diaphragm being movably supported by said support body and said driver arrangements being rigidly supported by said support body.

7. The loudspeaker driver of claim 6, wherein said terminal boundary is coupled to a surround which is directly coupled to said support body.

8. The loudspeaker driver of claim 6, wherein said movable diaphragm is coupled to a surround which is coupled to said support body through a frame.

9. The loudspeaker driver of claim 6, wherein said support body is a front board of a cabinet.

10. The loudspeaker driver of claim 1, wherein each driver arrangement is received in a respective recess in said support body.

11. The loudspeaker driver of claim 1, wherein each driver arrangement is received in a respective opening in said support body.

12. The loudspeaker driver of claim 1, wherein said voice coils are series connected.

13. The loudspeaker driver of claim 1, wherein said voice coils are parallel connected.

14. A loudspeaker driver, comprising: a movable diaphragm having an open mouth defined by a terminal boundary residing at the outermost lateral edge of said diaphragm surrounding the entire interior surface area of said diaphragm; a plurality of driver arrangements each including a voice coil suspended in a magnetic field, mechanically coupled to said movable diaphragm and disposed lateral to said outermost lateral edge of said movable diaphragm; and a support body, said diaphragm being movably supported by said support body and said driver arrangements being rigidly supported by said support body; wherein said support body is a front board of a cabinet.

15. The loudspeaker driver of claim 14, further comprising a transmission body mechanically coupled to said diaphragm and said driver arrangements to transmit force from said voice coils to said diaphragm.

16. The loudspeaker driver of claim 15, wherein said transmission body is mechanically coupled to a back surface of said diaphragm.

17. The loudspeaker driver of claim 14, wherein each driver arrangement is received in a respective recess in said support body.

18. The loudspeaker driver of claim 14, wherein each driver arrangement is received in a respective opening in said support body.

19. The loudspeaker driver of claim 14, wherein said voice coils are either series connected or parallel connected.

20. A loudspeaker driver, comprising: a movable diaphragm having an open mouth defined by a terminal boundary residing at the outermost lateral edge of said diaphragm surrounding the entire interior surface area of said diaphragm; a plurality of driver arrangements each including a voice coil suspended in a magnetic field, mechanically coupled to said movable diaphragm and disposed lateral to said outermost lateral edge of said movable diaphragm; and a transmission body mechanically coupled to said diaphragm and said driver arrangements to transmit force from said voice coils to said diaphragm, wherein said transmission body includes an inner core and a cladding on at least one exterior surface of said inner core, said inner core being softer than said cladding.

21. The loudspeaker driver of claim 20, further comprising a support body, said diaphragm being movably supported by said support body and said driver arrangements being rigidly supported by said support body.

22. The loudspeaker driver of claim 21, wherein each driver arrangement is received in a respective recess in said support body.

23. The loudspeaker driver of claim 21, wherein each driver arrangement is received in a respective opening in said support body.

24. The loudspeaker driver of claim 21, wherein said support body is a front board of a cabinet.

25. The loudspeaker driver of claim 20, wherein said transmission body is mechanically coupled to a back surface of said diaphragm.

26. The loudspeaker driver of claim 20, wherein said voice coils are either series connected or parallel connected.

* * * * *